US012635824B2

(12) United States Patent
Williams

(10) Patent No.: US 12,635,824 B2
(45) Date of Patent: May 26, 2026

(54) WINDOW CURTAIN ROD ASSEMBLY

(71) Applicant: Susan Williams, Little Rock, AR (US)

(72) Inventor: Susan Williams, Little Rock, AR (US)

( * ) Notice: Subject to any disclaimer, the term of this patent is extended or adjusted under 35 U.S.C. 154(b) by 19 days.

(21) Appl. No.: 18/912,816

(22) Filed: Oct. 11, 2024

(65) Prior Publication Data

US 2026/0102011 A1 Apr. 16, 2026

(51) Int. Cl.
*A47H 1/122* (2006.01)
*A47H 1/102* (2006.01)

(52) U.S. Cl.
CPC ..... *A47H 1/122* (2013.01); *A47H 1/102* (2013.01)

(58) Field of Classification Search
CPC ..... A47H 1/122; A47H 1/12; A47H 1/102
See application file for complete search history.

(56) References Cited

U.S. PATENT DOCUMENTS 828,503 A * 8/1906 Powell ..... A47H 1/13 248/252
1,328,136 A * 1/1920 Dorsey ..... A47H 1/102 160/110
2,123,622 A * 7/1938 Baginski ..... A47H 5/09 248/265
2,419,140 A * 4/1947 Jacque ..... A47H 1/122 248/265
2,702,128 A * 2/1955 Marron ..... A47H 1/122 248/265
3,614,045 A * 10/1971 Cegielski, Jr. ..... A47H 1/12 248/262
3,788,376 A * 1/1974 Mednick ..... A47H 5/032 160/19
5,472,102 A * 12/1995 Clayton ..... A47H 1/122 248/265
9,049,952 B2 * 6/2015 Amos ..... A47H 1/122
9,717,361 B2 * 8/2017 Amos ..... A47H 1/142

* cited by examiner

*Primary Examiner* — Eret C Mcnichols
(74) *Attorney, Agent, or Firm* — The Keys Law Firm PLLC

(57) ABSTRACT

A window curtain rod assembly structured to be able to position a curtain rod above a window while being secured at the window without being permanently mounted to a wall. The window curtain rod assembly employs a pair of mounting members which each independently can be fixed vertically between the upper and lower window sill of a target window. Attached to each tension rod is a mounting arm, with one of the rod arm operative to extend a location above and in front of the window adjacent to one transverse side of the window, and the other operative to extend a location above and in front of the window adjacent to the other transverse side of the window. The rod arms each include a rod holder which allows a curtain rod to rest on the rod holders and extend between the rod arms.

18 Claims, 2 Drawing Sheets

WINDOW CURTAIN ROD ASSEMBLY

BACKGROUND OF THE INVENTION

Field of the Invention

This invention relates to window curtain rods and, more particularly, to a window curtain rod assembly which can position a curtain rod above a window while being secured on the window without being permanently mounted to a wall.

Description of the Prior Art

The use of curtain rods to suspend curtains (or draperies) above a window on the inside so as to allow the curtain to hand over the window is well established. When it is desired to put curtains up on a window, curtain rods are commonly installed on the window by attaching two or more brackets or other holding mechanisms to the wall near the window and then suspending from the brackets a rod such in a manner which allows the rod to rest on, and extend between, the brackets. Typically, such brackets are attached through the use of elongated mechanical fasteners, such as screws, which can be passed through the bracket and into the wall. In other scenarios, alternate fastening mechanisms, such as adhesives, may be employed A problem which still exists, however, is that in some cases, it may not be desirable or reasonably possible to pass a screw or other fastener into the wall in order to secure brackets thereto. For example, some may desire to not cause any damage to the wall by inserting an elongated mechanical fastener therein. Also, some walls, such as college dorm rooms, may be constructed of concrete and thus may not be overly suitable for a bracket to be screwed therein. Similarly, in some scenarios it may not be desirable to use an adhesive to attach a curtain rod bracket to a wall.

Thus, there remains a need for a window curtain rod assembly which can fixedly position a curtain rod above a window without using brackets or other holding mechanisms that are attached with a fastener or adhered to the wall. It would be desirable for such a window curtain rod assembly to be structured to allow the height of the rod holders, the distance between rod holders, and the distance of the rod holders from the window to be adjusted during and after installation. It would additionally be desirable for such a window curtain rod assembly to employ a window attachment system which can be deployed on windows of varying sizes.

SUMMARY OF THE INVENTION

The present disclosure provides for a window curtain rod assembly, comprising: at least two mounting members, each adapted to be secured in place between an upper window sill and a lower window sill of a target window; at least two mounting arms, wherein each of the at least two mounting arms is moveably attached at one end to a distinct mounting member among the at least two mounting members; a rod holder integral with each mounting arm, wherein each of the rod holders forms an end of the mounting arm to which the rod holder is integral that is opposite the end of the mounting arm that is attached to the mounting member; wherein the rod holders are each adapted to receive and hold an elongated rod; and wherein each of the mounting arms are adapted to be selectively positioned such that the height of the rod holders, the distance between rod holders, and the distance of the rod holders from the window can be adjusted during and after installation.

It is an object of the present disclosure to provide a window curtain rod assembly which can fixedly position a curtain rod above a window without using brackets or other holding mechanisms that are attached with a fastener or adhered to the wall.

It is an additional object of the present disclosure to provide a window curtain rod assembly which allows the height of the rod holders, the distance between rod holders, and the distance of the rod holders from the window to be adjusted during and after installation.

It is yet another object of the present disclosure to provide a window curtain rod assembly which has a window attachment system which can be deployed on windows of varying sizes.

DETAILED DESCRIPTION OF THE INVENTION

Described herein is a window curtain rod assembly structured to be able to position a curtain rod above a window while being secured at the window without being permanently mounted to a wall. The window curtain rod assembly employs a pair of mounting members which each independently can be fixed vertically between the upper and lower window sill of a target window. Attached to each tension rod is a mounting arm, with one of the rod arm operative to extend a location above and in front of the window adjacent to one transverse side of the window, and the other operative to extend a location above and in front of the window adjacent to the other transverse side of the window. The rod arms each include a rod holder which allows a curtain rod to rest on the rod holders and extend between the rod arms.

Figure 1:
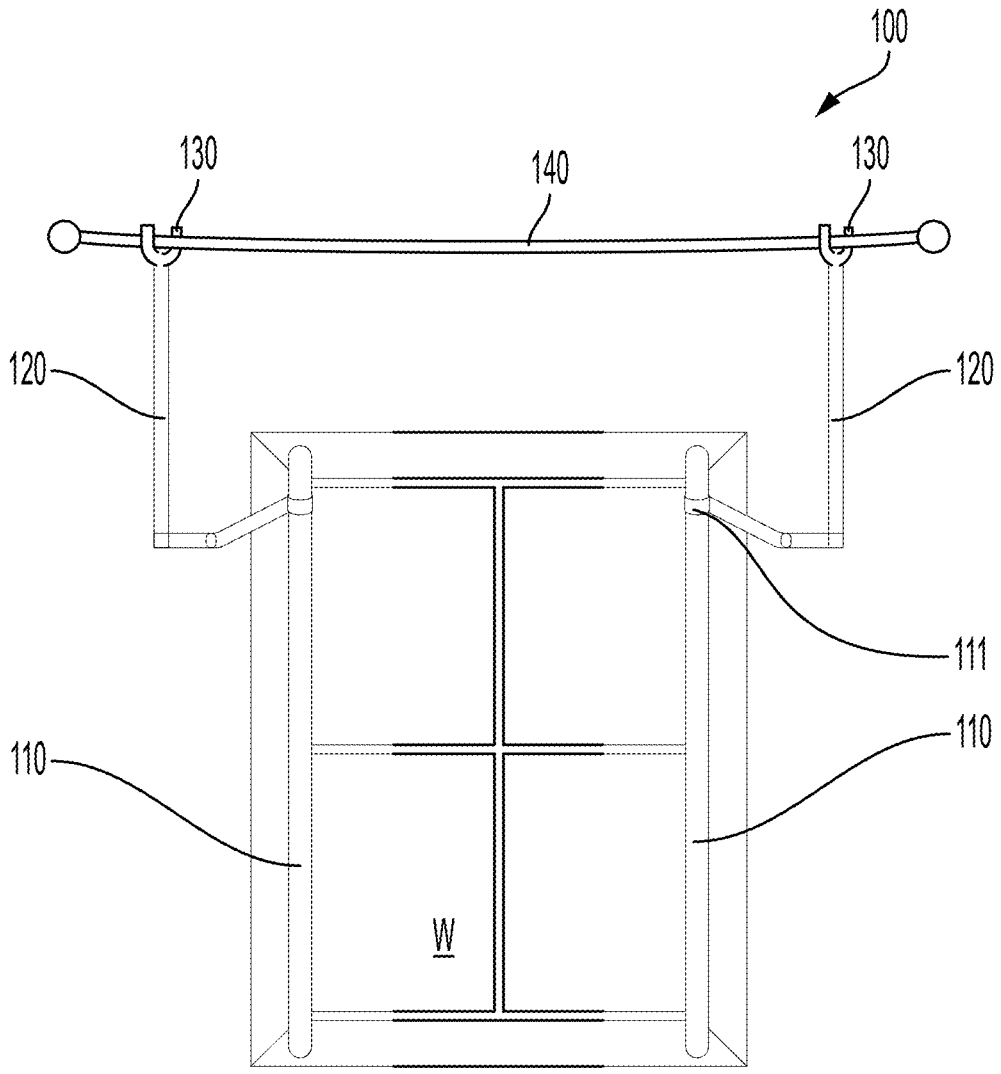
FIG. 1 is a front elevational view of a window curtain rod assembly built in accordance with the present disclosure, shown in place on a window.
Figure 2:
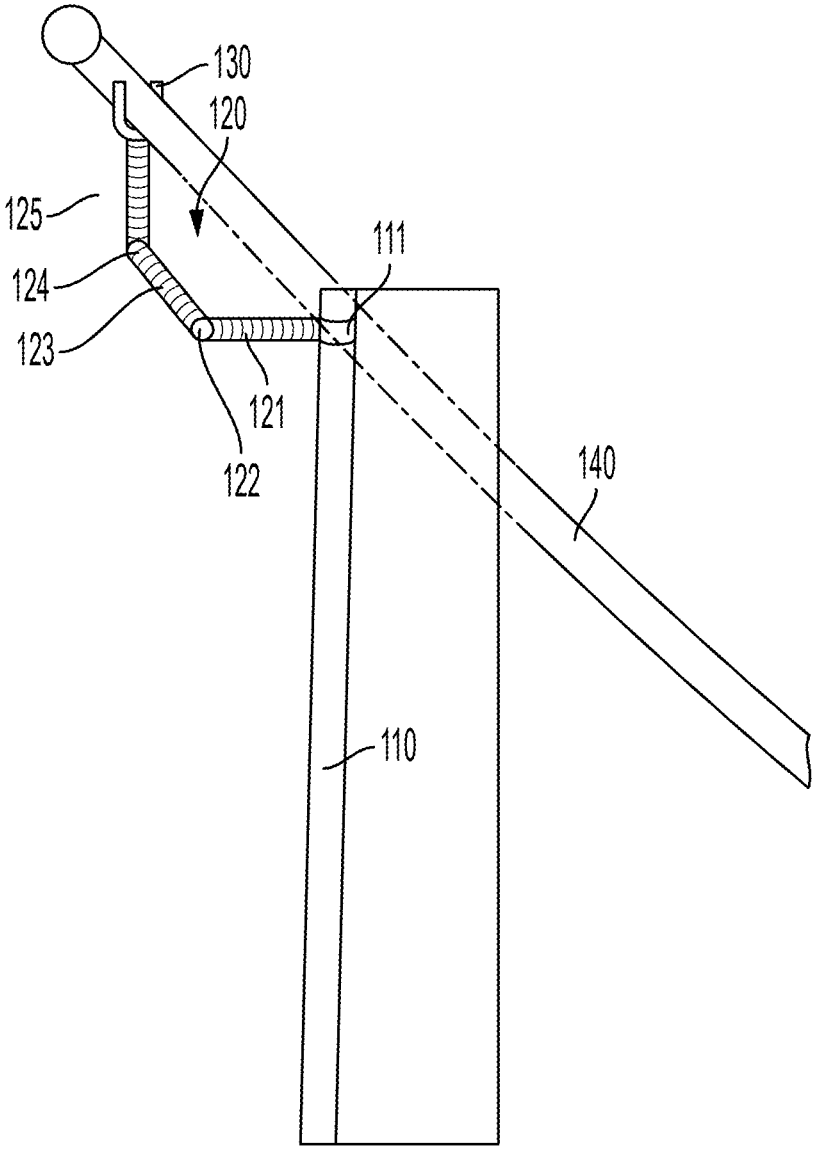
FIG. 2 is a side perspective view of a window curtain rod assembly built in accordance with the present disclosure, shown in place on a window.

Referring now to the drawings and, in particular, FIGS. 1 and 2, a window curtain rod assembly 100 is shown having a pair of mounting members 110, a pair of mounting arms 120, a pair of rod holders 130, and a curtain rod 140. Each of the pair of mounting members 110 is adapted to be secured in place between an upper window sill and a lower window sill of a target window, and may be defined by a spring loaded tension rod sized to extend between the upper window sill and the lower window sill while maintaining sufficient tension to hold in place. The mounting members 110 may be formed from a pair of nesting cylinders, each constructed of a rigid material, such as plastic or metal. Embodiments of the mounting members 110 may be approximately 1.5" diameter and stainless steel bodies which are rust proof and holds up to 100 pounds. The ends of each mounting member 110 may be widened or may be of the substantially the same cylindrical size as the rest of it. Moreover, the ends of the mounting members 110 may include a removable cap or may otherwise include non-slip material on the surfaces which will contact the window sill.

Each of the pair of mounting arms 120 is attached to and extends from a discrete one of the mounting members 110. At one end, each mounting arm 120 is adapted to be clamped to the cylindrical body of one of the mounting members 110. In this regard, each mounting arm 120 may include a clamping member 111 defined by a C clamp, crab clamp, tri-clamp or other screw clamping device. Forming the bulk of the structure of each mounting arm 120 may be three rigid arm portions 121, 123, 125, constructed of a metal or hard plastic material. Each mounting arm 120 may additionally include a first movable joint 122 and a second movable joint 124, which each may be embodied as swivel ball joints. In this regard, a given mounting arm may include a connected components in the following arrangement: clamping member to a first of the arm portions 121 to the first movable joint 122 to a second of the arm portions 123 to the second moveable joint 124 to the third of the arm portions 125. At the end of the third arm portion 125 opposite to the second movable joint 124 may be a rod holder 130.

The rod holders 130 are adapted to receive and hold a curtain rod 140. In this regard, the rod holders 130 may be U shaped such that when they is facing with the open end up, a cylindrical and/or elongated curtain rod can be placed therein. Alternatively, the rod holders 130 may form a closed geometric shape such as an elliptical or rectangular shape which can receive and hold a curtain 140 that is slid into it.

Through the segmented structure defined by the first of the arm portions 121, the first movable joint 122, the second of the arm portions 123, the second moveable joint 124, and the third of the arm portions 125, each of the mounting arms 120 are adapted to be selectively positioned such that the height of the rod holders 130, the distance between rod holders 130, and the distance of the rod holders 130 from the window can be adjusted during and after installation. In this regard, it is contemplated that the first movable joint 122 and second movable joint 124 may be formed to allow the arm portions 121, 123, 125 to be moved relative to one another only through the application of direct and intentional manual force (i.e., to allow for selective positioning) and sufficiently restrict movement due to gravity or other non-manual forces (i.e., to maintain selective positioning that has been provided). As such, the mounting arms 120 are structured to allow the height, depth, and width of the rod holder 130 for each mounting arm 120 to be adjusted relative to the mounting members 110, and thus to a window that the window curtain rod assembly 100 is mounted to.

In use, the window curtain rod assembly 100 may be mounted on a window W having an upper window sill and a lower window sill by attached one of the mounting members 110 on the left side of a window cavity of a target window between the upper and lower sill and the other mounting member 110 on the right side of the window cavity of the target window between the upper and lower sill. Then, one of the mounting arms 120 may be attached to the left side mounting member 110 adjacent to its upper end and the other mounting arm 120 may be attached to the right side mounting member 110 adjacent to its upper end. Once the mounting arms 120 are attached, the mounting arms 120 may each be moved as desired by a user so that the rod holders 130 can be positioned at the desired height above the window opening and desired distance in front of the window aesthetically, and so that rod holders 130 are positioned at a desired distance apart from one another to ensure they can adequately and safely hold a curtain rod 140 that is holding a curtain C. Once the mounting arms 120 and rod holders 130 are positioned satisfactorily, the curtain rod 140 may then be placed to rest on, and extend between, the rod holders 130.

It is contemplated that in some instances, having the mounting arms 120 extend the rod holders 130 out between 4 and 8 inches from the wall may be desirable.

In this regard, the window curtain rod assembly 100 forms an instant drapery hanging system with the mounting member 110 able to quickly and securely attach inside the window sill, the mounting arms 120 each operating like an articulated arm with adjustable height, width and depth that allows a customizable fit over a wide range of window styles, and the rod holders 130 at the highest point of the system to hold a drapery rod. In this regard, there is no need for tools, nails, screws or adhesives, and it can be assembled in minutes, disassembled, reused and portable.

Advantageously, the use of the side edges of a window sill provides a perfect way to tuck the mechanics of drapery hanging out of sight, creating a non-obstructive view through the window. Furthermore, such an approach works well for concrete walls such as in a dorm room or a high-end home, and also for anywhere one does not want to leave holes in the walls. This window curtain rod assembly 100 may be sufficiently strong to support commercial or residential drapes.

In alternate embodiments, it is contemplated that the mounting member 110 may be constructed to attaching to and extend between a floor to ceiling. Such an application would not be as tucked away, but it would allow the window curtain rod assembly 100 to be deployed with some more modern windows which are flush with walls and have no window sills.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A window curtain rod assembly, comprising:

at least two mounting members, each defined by a spring loaded tension rod and adapted to be secured in place between an upper window sill and a lower window sill of a target window;

at least two mounting arms, wherein each of the at least two mounting arms is moveably attached at one end to a distinct mounting member among the at least two mounting members;

a rod holder integral with each mounting arm, wherein each of the rod holders forms an end of the mounting arm to which the rod holder is integral that is opposite the end of the mounting arm that is attached to the mounting member;

wherein the rod holders are each adapted to receive and hold an elongated rod; and wherein each of the mounting arms are adapted to be selectively positioned such that the height of the rod holders, the distance between rod holders, and the distance of the rod holders from the window can be adjusted during and after installation.

2. The window curtain rod assembly of claim 1, additionally comprising an elongated curtain rod which rests on and extends between at least two of the rod holders.

3. The window curtain rod assembly of claim 1, wherein each mounting arm is attached adjacent to an upper end of the distinct mounting member to which it the mounting arm is attached.

4. The window curtain rod assembly of claim 3, wherein each mounting arm is adapted to be clamped to the one of the mounting members so as allow the mounting arm to be moveably attached one of the mounting members.

5. The window curtain rod assembly of claim 4, wherein each mounting arm is formed from a plurality of discrete, rigid arm portions.

6. The window curtain rod assembly of claim 4, wherein each mounting arm is formed from a plurality of discrete, rigid arm portions and have a plurality of moveable joints.

7. The window curtain rod assembly of claim 1, wherein each mounting arm is attached adjacent to an upper end of the distinct mounting member to which it the mounting arm is attached.

8. The window curtain rod assembly of claim 1, wherein each mounting arm is adapted to be clamped to the one of the mounting members so as allow the mounting arm to be moveably attached one of the mounting members.

9. The window curtain rod assembly of claim 1, wherein each mounting arm is formed from a plurality of discrete, rigid arm portions.

10. The window curtain rod assembly of claim 1, wherein each mounting arm is formed from a plurality of discrete, rigid arm portions and have a plurality of moveable joints.

11. A window curtain rod assembly, comprising:

at least two mounting members, each defined by a spring loaded tension rod and adapted to be secured in place between an upper window sill and a lower window sill of a target window;

at least two mounting arms, wherein each of the at least two mounting arms is moveably attached at one end to an upper end of a distinct mounting member among the at least two mounting members;

a rod holder integral with each mounting arm, wherein each of the rod holders forms an end of the mounting arm to which the rod holder is integral that is opposite the end of the mounting arm that is attached to the mounting member;

wherein the rod holders are each adapted to receive and hold a curtain rod; and wherein each of the mounting arms are adapted to be selectively positioned such that the height of the rod holders, the distance between rod holders, and the distance of the rod holders from the window can be adjusted during and after installation.

12. The window curtain rod assembly of claim 11, additionally comprising an elongated curtain rod which rests on and extends between at least two of the rod holders.

13. The window curtain rod assembly of claim 11, wherein each mounting arm is adapted to be clamped to the one of the mounting members so as allow the mounting arm to be moveably attached one of the mounting members.

14. The window curtain rod assembly of claim 11, wherein each mounting arm is formed from a plurality of discrete, rigid arm portions.

15. The window curtain rod assembly of claim 11, wherein each mounting arm is formed from a plurality of discrete, rigid arm portions and have a plurality of moveable joints.

16. A window curtain rod assembly, comprising:

at least two mounting members, each defined by a spring loaded tension rod and sized to be secured in place between an upper window sill and a lower window sill of a target window;

at least two mounting arms, wherein each of the at least two mounting arms is moveably attached at one end to an upper end of a distinct mounting member among the at least two mounting members;

a rod holder integral with each mounting arm, wherein each of the rod holders forms an end of the mounting arm to which the rod holder is integral that is opposite the end of the mounting arm that is attached to the mounting member;

wherein the rod holders are each adapted to receive and hold a curtain rod;

wherein each of the mounting arms is formed from a plurality of discrete, rigid arm portions which are together adapted to be selectively positioned such that the height of the rod holders, the distance between rod holders, and the distance of the rod holders from the window can be adjusted during and after installation;

an elongated curtain rod which rests on and extends between at least two of the rod holders.

17. The window curtain rod assembly of claim 16, wherein each mounting arm is adapted to be clamped to the one of the mounting members so as allow the mounting arm to be moveably attached one of the mounting members.

18. The window curtain rod assembly of claim 16, wherein each mounting arm additionally includes a plurality of moveable joints.

* * * * *